US008682223B2

(12) United States Patent
Momotani

(10) Patent No.: US 8,682,223 B2
(45) Date of Patent: Mar. 25, 2014

(54) IMAGE FORMING DEVICE FOR SUPPRESSING DEVELOPER CONSUMPTION

(75) Inventor: Keiko Momotani, Ibaraki (JP)

(73) Assignee: Konica Minolta Holdings, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/823,973

(22) PCT Filed: Jul. 28, 2011

(86) PCT No.: PCT/JP2011/067240
§ 371 (c)(1),
(2), (4) Date: Mar. 15, 2013

(87) PCT Pub. No.: WO2012/043050
PCT Pub. Date: Apr. 5, 2012

(65) Prior Publication Data

US 2013/0177337 A1 Jul. 11, 2013

(30) Foreign Application Priority Data

Sep. 28, 2010 (JP) ..... 2010-217299

(51) Int. Cl.
*G03G 15/10* (2006.01)

(52) U.S. Cl.
USPC ..... 399/239; 399/57

(58) Field of Classification Search
USPC ..... 399/281, 237, 239, 57
See application file for complete search history.

(56) References Cited

U.S. PATENT DOCUMENTS

| | | | | |
|---|---|---|---|---|
| 6,347,208 | B1 * | 2/2002 | Yamamoto | 399/281 |
| 8,295,720 | B2 * | 10/2012 | Shiori | |
| 2008/0101806 | A1 * | 5/2008 | Tabata et al. | |

FOREIGN PATENT DOCUMENTS

| | | | |
|---|---|---|---|
| JP | 2-71285 | A | 3/1990 |
| JP | 11-249402 | A | 9/1999 |
| JP | 2001-75365 | A | 3/2001 |
| JP | 2002-341653 | A | 11/2002 |
| JP | 2006-91219 | A | 4/2006 |
| JP | 2006-343676 | A | 12/2006 |
| JP | 2006349879 | A * | 12/2006 |
| JP | 2009-175425 | A | 8/2009 |
| JP | 2010-85648 | A | 4/2010 |
| JP | 2010-175731 | A | 8/2010 |

OTHER PUBLICATIONS

International Search Report (PCT/ISA/210) issued on Aug. 23, 2011, by the Japanese Patent Office as the International Searching Authority for International Application No. PCT/JP2011/067240.
Written Opinion (PCT/ISA/237) issued on Aug. 23, 2011, by the Japanese Patent Office as the International Searching Authority for International Application No. PCT/JP2011/067240.
Decision to Grant Patent issued Nov. 15, 2011 with English language translation.

* cited by examiner

*Primary Examiner* — Susan Lee
(74) *Attorney, Agent, or Firm* — Buchanan Ingersoll & Rooney PC

(57) ABSTRACT

An image forming device includes a development member carrying a developer for forming a toner image at an image carrier, a cleaning member abutting against the development member for removing the developer remaining on the development member, a transportation member provided in contact with the development member for transporting the developer supplied to the development member, and a driving unit controlling driving of at least one of the transportation member and the development member. The driving unit executes preliminary driving of the development member and transportation member for a given time under a state where supply of the developer to the transportation member is stopped, prior to main driving in image formation. Consumption and/or degradation of the developer in preliminary driving is suppressed while strain at the development member or transportation member formed of a resilient member is removed.

12 Claims, 6 Drawing Sheets

(A)

(B)

IMAGE FORMING DEVICE FOR SUPPRESSING DEVELOPER CONSUMPTION

TECHNICAL FIELD

The present invention relates to an electrophotographic image forming device such as a copy machine, printer, and facsimile, and relates to an image forming device including a development member such as a development roller.

BACKGROUND ART

In an electrophotographic image forming device, an electrostatic latent image on a photoreceptor that is an image carrier is developed with the toner using a development device to form a toner image. The toner image on the photoreceptor is transferred onto a recording sheet, for example. In the transfer process of such an image forming device, the electrostatic transfer scheme is generally employed.

When a toner image is transferred onto a sheet that is the transferring body, voltage is applied by means of a transfer roller or the like from the backside of the sheet arranged to face the photoreceptor. An electric field is developed between the photoreceptor and the recording sheet, which causes the toner image to be electrostatically adsorbed onto the recording sheet.

Then, the transferred toner image is fixed on the recording sheet by a fixing device applying pressure.

For the development device of an image forming device, there are conventionally known a wet type development device and a dry type development device, both supplying a developer to a development roller that is a resilient member through a transportation roller, allowing the electrostatic latent image on the photoreceptor to be developed by the development roller. In such a development device, the development roller that is a resilient member takes a stopped state when an image is not formed, i.e. in a non-image formation state.

A continuing state of the surface of the resilient member (development roller) partially pressed in contact with another member (for example, transportation roller) causes compressive strain at the contacting region on the surface of the resilient member. Since the contact pressure between the members will be degraded at the region where such compressive strain is generated, the developer cannot be delivered evenly when the resilient member begins to rotate again for image formation, leading to the problem of unevenness in the density by the rotation cycle of the resilient member.

The mechanism of density unevenness occurring by the strain will be described hereinafter based on a wet type development device.

In the case where the member at the delivering side of the liquid developer and the member at the receiving side of the liquid developer are rotating in the same direction at the facing region, the liquid developer will pass through the nip between the members to be distributed to each member generally in the proportion corresponding to the speed ratio of the members.

However, the event of a strain at the surface of the resilient member will probably cause more liquid developer to be carried at the region that is concave by the strain.

Therefore, in the case where there is a strain at the member of the delivering side and more developer is carried at that region, the transported amount on the member of the receiving side opposite to that certain region will be increased.

In the case where the member at the delivering side of the liquid developer and the member at the receiving side of the liquid developer are rotating in opposite directions at the facing region, the liquid developer on the member of the delivering receiving side will not pass through the nip between the members, and will be transported to the member of the receiving side prior to passage through the nip. However, if there is a strain at the member of the delivering side, the liquid developer will readily pass through the nip between the members since the contact pressure is reduced where such strain occurs. Therefore, the amount of the liquid developer transported onto the member of the receiving side will be reduced at the passing-through region.

By the above-described mechanism, the generation of a strain at the resilient member will increase or reduce the amount the liquid developer to be transported, leading to occurrence of uneven density corresponding to the rotating cycle of the resilient member with a strain.

Such a problem in uneven density occurs similarly in a dry type development device.

PTL 1 discloses the approach of, in a liquid development device including a development roller, a developer transportation roller supplying a liquid developer to the development roller, and a developer supply roller supplying the liquid developer to the developer transportation roller, reducing the circumferential speed difference of these rollers in a startup operation than in a developing operation in order to reduce the torque during startup. Furthermore, PTL 2 discloses the approach of shifting the position of the development roller and application roller in the thrust direction from an unstable state to a stable state (steady state) by executing a rotation driving operation of the development roller and application roller (a preliminary driving operation), prior to the timing of starting a developing operation.

The art disclosed in PTL 1 and PTL 2 proposes the scheme of rotating a development roller or the like at the time of starting the development device or prior to an image formation operation.

CITATION LIST

Patent Literature

PTL 1: Japanese Laid-Open Patent Publication No. 2006-343676

PTL 2: Japanese Laid-Open Patent Publication No. 2006-91219

SUMMARY OF INVENTION

Technical Problem

The scheme disclosed in the aforementioned PTL 1 and PTL 2 is not directed to rotating a development roller or the like prior to image formation to overcome a strain generated at the development roller or the like. Furthermore, since the rollers are rotated with the developer attached, the developer will be removed by a cleaning blade or the like provided at the development roller to result in extra consumption of the developer. There was also the problem of degradation in the property of the developer caused by friction or the like with another member.

In view of the foregoing, an object of the present invention is to provide an image forming device that can have strain removed and that can suppress consumption and/or degradation of the developer.

Solution to Problem

An image forming device according to an aspect of the present invention includes a development member carrying a developer for forming a toner image at an image carrier, a cleaning member abutting against the development member for removing the developer remaining on the development member, a transportation member provided in contact with the development member for transporting the developer supplied to the development member, and a driving unit controlling driving of at least one of the transportation member and development member. At least one of the development member and transportation member is formed of a resilient material. The driving unit executes preliminary driving of the development member and transportation member for a given time under a state where supply of the developer to the transportation member is stopped, prior to main driving in image formation.

Preferably, the driving unit rotates, in preliminary driving, the development member in a direction opposite to the rotating direction during main driving.

Preferably, the driving unit rotates the development member and the transportation member without speed difference during preliminary driving when the development member and the transportation member are driven to rotate in the same direction at a contact region thereof.

Preferably, the driving unit controls driving of only one of the transportation member and the development member, and the other of the transportation member and the development member is driven following rotation of the driving.

Preferably, the developer is a liquid developer, supplied before the driving unit stops the preliminary driving.

Preferably, the cleaning member abuts against the development member from a counter direction to the rotating direction of the development member during main driving.

Preferably, the image forming device further includes a reservoir for storing a developer to be supplied to the transportation member, and a pump unit supplying, during main driving, a developer to the reservoir such that at least a portion of the transportation member is immersed in the developer, and discharging the developer from the reservoir such that the transportation member is not immersed in the developer when preliminary driving is initiated.

Advantageous Effects of Invention

In the image forming device of the present invention, the driving unit drives the development member and transportation member in a preliminary manner for a given time under a state where supply of the developer to the transportation member is stopped, prior to main driving in image formation. By the preliminary driving, strain generated at the development member or the like is eliminated. Furthermore, since preliminary driving is executed under the state where supply of the developer is stopped, the developer does not have to be removed by a cleaning member during that period. Therefore, consumption and/or degradation of the developer can be suppressed.

DESCRIPTION OF EMBODIMENTS

Figure 1:
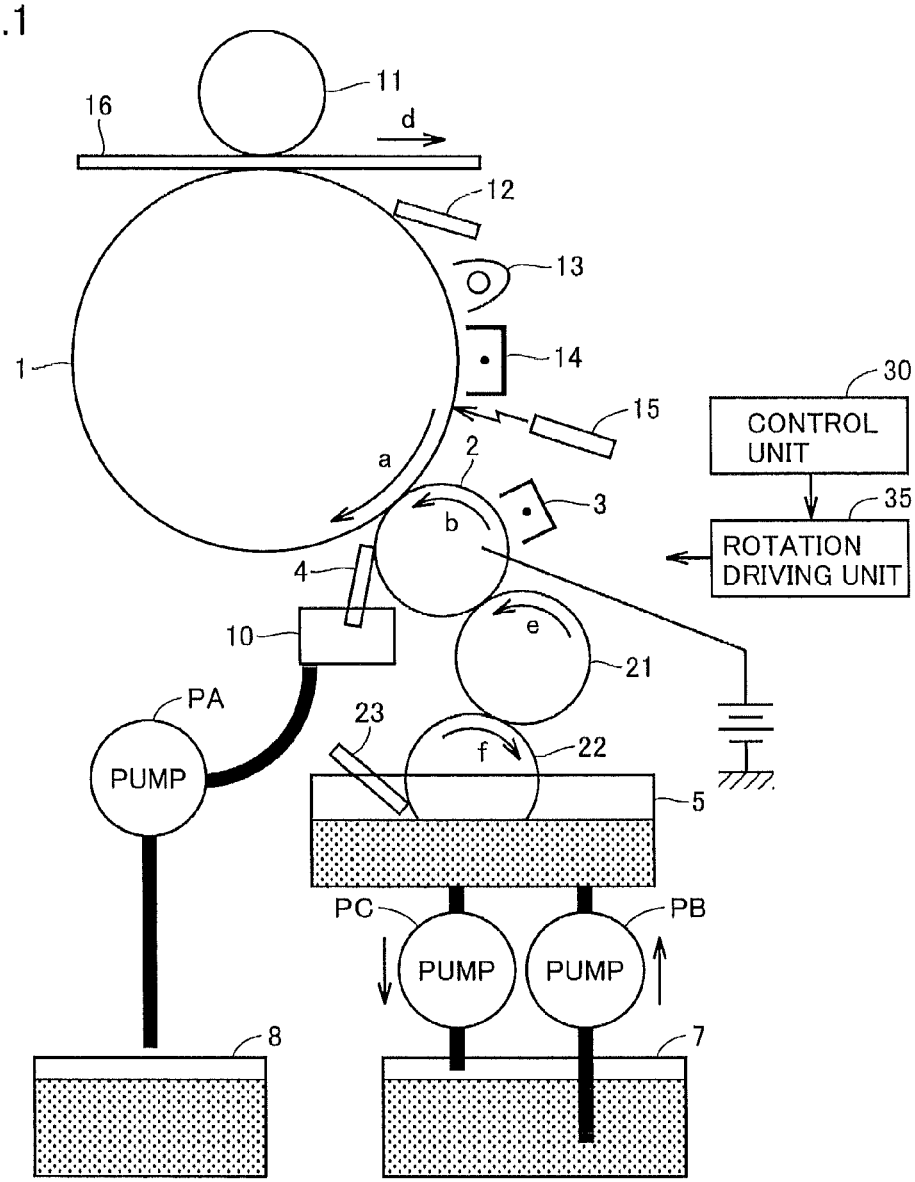
FIG. 1 schematically represents a wet type image forming device using a liquid developer according to an embodiment of the present invention.

Embodiments of the present invention will be described hereinafter with reference to the drawings. In the following description, the same components and constituent elements have the same reference characters allotted. Their designation and function are also identical.

Although a wet type image forming device will be described typically as an example of an image forming device in an embodiment of the present invention, the same applies to a dry type image forming device.

FIG. 1 schematically represents a wet type image forming device using a liquid developer according to the embodiment of the present invention.

Referring to FIG. 1, a photoreceptor 1 is an electrostatic latent image carrier, having a predetermined surface potential applied by a charger 14. Then, an exposure unit 15 causes laser modulated according to an image signal from a digital image processing unit not shown to be directed to photoreceptor 1 to form an electrostatic latent image.

A development roller 2 is arranged with a predetermined amount of pushing against photoreceptor 1. The toner on development roller 2 is transferred towards photoreceptor 1 according to the electrostatic latent image on photoreceptor 1 upon application of a predetermined bias voltage.

By this toner transfer, the electrostatic latent image on photoreceptor 1 is rendered visual as a toner image.

Then, the toner image on photoreceptor 1 is transferred onto a recording medium 16 by a transfer bias voltage applied from a transfer bias voltage applying means not shown at transfer roller 11. In the present example, the recording medium is shown corresponding to the case conveyed in direction d.

The surface of photoreceptor 1, following passage of the position facing the transfer roller, is cleaned by a cleaning blade 12 that is a cleaning member, and then discharged by an eraser unit 13, and then passes again the position facing charger 14. Photoreceptor 1 rotates in direction a.

Although FIG. 1 shows direct transfer onto recording medium 16 from photoreceptor 1, a mode of temporary transfer to an intermediate transfer body, followed by overlapping of another color to be transferred onto recording medium 16 is allowed.

At the development device where development roller 2 is located, a liquid development reservoir 5 storing a liquid developer is provided. The liquid developer is drawn up by a metal roller whose surface has fine works (anilox roller) 22, partially immersed in the liquid developer in liquid development reservoir 5.

The liquid developer drawn up has a measured amount of developer to be transmitted by means of a doctor blade 23. The developer is transported to transportation roller 21, and then to development roller 2.

The toner on development roller 2 is charged by a charging device 3. The charged toner renders the latent image at photoreceptor 1 visual by application of a predetermined bias voltage. Following development, any toner remaining on development roller 2 is removed by a cleaning blade 4. The liquid developer removed by cleaning blade 4 is accumulated in a collecting bin 10. The liquid developer accumulated in collecting bin 10 is transported to an adjustment tank 8 via a pump PA. The developer is adjusted in concentration at adjustment tank 8 to be supplied to, for example, a tank 7 that will be described afterwards for reuse.

At liquid development reservoir 5, there are provided pumps PB and PC. The pumping operation by pump PC allows the liquid developer accumulated in liquid development reservoir 5 to be output to tank 7.

Furthermore, the pumping operation by pump PB allows the developer to be output from tank 7 to liquid development reservoir 5.

FIG. 1 represents the case where there are provided a control unit 30 for effecting overall control of the wet type image forming device, and a rotation driving unit 35 for controlling the rotation of development roller 2 and transportation roller 21.

Control unit 30 instructs rotation driving unit 35 during image formation and the like to control the rotation of development roller 2 and the like.

As will be described afterwards, control unit 30 instructs rotation driving unit 35, as necessary, prior to formation of an image, to execute a preliminary driving operation in which development roller 2 and transportation roller 21 are rotated.

The liquid developer includes, as the main components, insulative liquid that is the carrier liquid, toner particles for developing an electrostatic latent image, and a dispersing agent to disperse the toner particles.

Any carrier liquid generally employed for a liquid developer directed to electrophotography may be used without particular limitation. A non-volatile liquid is preferable. As a non-volatile liquid, silicon oil, mineral oil, paraffin oil, paraffinum liquidum and the like can be cited.

Any toner particles generally employed for a liquid developer directed to electrophotography may be used without particular limitation. For the toner binder resin, thermoplastic resin such as polystyrene resin, styrene acrylic resin, acrylic resin, polyester resin, epoxy resin, polyamide resin, polyimide resin, or polyurethane resin can be used. A plurality of the cited resins may be mixed for usage. Furthermore, commercially available pigments and dyes may be used for toner coloring. For example, carbon black, colcothar, titanium oxide, silica, phthalocyanine blue, phthalocyanine green, sky blue, benzidine yellow, Lake Red D, or the like can be used as the pigment. As the dye, Solvent Red 27, Acid Blue 9, or the like can be used.

The liquid developer can be prepared according to techniques generally employed. For example, binder resin and pigment are prepared at a predetermined compounding ratio, melt-kneaded to be dispersed uniformly using a pressure kneader, a roller mill, or the like. The obtained dispersion is finely pulverized by a jet mill, for example. The obtained fine powder is classified by an air classifier, for example, to obtain color toner of the desired grain size. The obtained toner particle is mixed with insulative liquid serving as carrier liquid at a predetermined compounding ratio. This mixture is dispersed uniformly by dispersing means such as a ball mill to obtain a liquid developer. By way of example, the toner grain size is preferably within the range of 0.1 μm to 5 μm. If the grain size is less than 0.1 μm, the developability is greatly degraded. If the grain size exceeds 5 μm, the image quality is degraded. Further, the ratio of the toner particles in the liquid developer is preferably approximately 10-40 mass %. If the ratio is less than 10 mass %, sedimentation of the toner particle is readily facilitated, imposing a problem in temporal stability during long-term storage. In order to obtain the required image density, a large amount of liquid developer must be supplied, which in turn increases the amount of carrier liquid adhering on the recording sheet. Drying must be performed during the fixing step, generating vapor, which may cause an environmental problem. If the ratio exceeds 40 mass %, the viscosity of the liquid developer becomes so high that there is the possibility of handling thereof becoming difficult.

In the present example, 100 parts of polyester resin and 15 parts of copper phthalocyanine were mixed sufficiently by a Henschel mixer, melt-kneaded using a twin-screw extruder rotating in the same direction at the heating temperature of 100° C. in the roll. The obtained mixture was cooled, and then coarse-grinded to obtain coarse-grinding toner. Also, 75 parts of IPS2028 (produced by Idemitsu Kosan Co., Ltd.), 25 parts of coarsely pulverized toner, and 0.8 parts of V216 (dispersing agent, produced by IPS Corporation) were mixed, wet-milled for 4 days by a sand mill to obtain a wet type developer. The grain size at this stage was 2.0 μm. The grain size was measured by a laser diffraction type particle size analyzer (SALD-2200 (manufactured by Shimadzu Corp.)).

Development roller 2 used had a 10 mm-thick polyurethane rubber of hardness 30 (JIS-A standard) provided on a metal core of ϕ20 mm, coated with 10 μm polyurethane resin.

Transportation roller 21 used had a 6 mm-thick polyurethane rubber of hardness 50 provided on a metal core of ϕ28 mm. For metal roller 22, an anilox roller of ϕ40 mm was used.

The amount of pushing between development roller 2 and transportation roller 21 was set at 0.1 mm. The amount of pushing between transportation roller 21 and metal roller 22 was set at 0.4 mm. 2 mm-thick polyurethane rubber was used for cleaning blade 4. For regulating member 23, a stainless blade of 0.15 mm in thickness was used.

As to the linear speed of each roller, development roller 2 was made to rotate at 400 mm/sec, transportation roller 21 at 400 mm/sec and metal roller 22 at 400 mm/sec.

Figure 2:
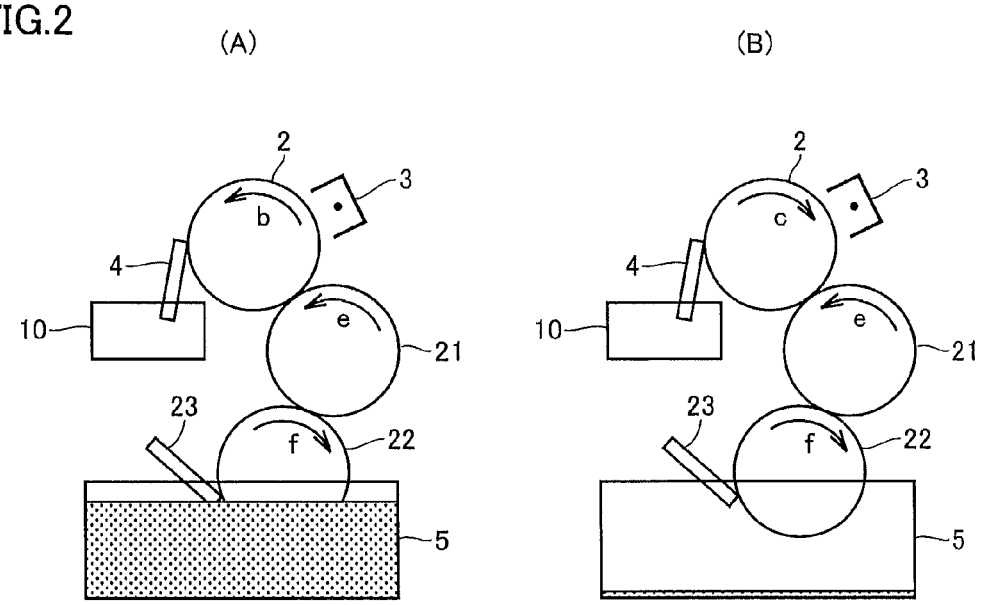
FIG. 2 is a diagram to describe main driving during image formation and preliminary driving prior to image formation according to the embodiment of the present invention.

FIG. 2 is a diagram to describe main driving during image formation and preliminary driving prior to image formation according to the embodiment of the present invention.

Referring to FIG. 2 (A), the main driving operation of the development device during image formation is illustrated.

Control unit 30 instructs rotation driving unit 35 to cause development roller 2 and the like at the development device to rotate. Specifically, rotation driving unit 35 causes transportation roller 21 to rotate in the direction of e and development roller 2 in the direction of b. In other words, transportation roller 21 and development roller 2 rotate in opposite directions at their contact region. It is assumed that metal roller 22 rotates in a driven manner following rotation of transportation roller 21. Therefore, the rotating direction of metal roller 22 is in the direction of f.

By causing each roller to rotate as set forth above, the liquid developer is drawn up from liquid development reservoir 5 by metal roller 22. An amount of liquid developer regulated by doctor blade 23 is transported to transportation roller 21. The liquid developer transported to transportation roller 21 is further supplied to development roller 2 from transportation roller 21.

Referring to FIG. 2 (B), the preliminary driving operation of the development device prior to image formation is illustrated.

Control unit 30 instructs rotation driving unit 35 to cause development roller 2 and the like at the development device to rotate. Specifically, rotation driving unit 35 causes transportation roller 21 to rotate in direction e that is the same in main driving, and causes development roller 2 to rotate in direction c opposite to direction b in main driving. It is assumed that metal roller 22 rotates in a driven manner following rotation of transportation roller 21. Therefore, the rotating direction of metal roller 22 is in the direction of f.

By the preliminary driving prior to image formation set forth above, a strain at the development roller and the like can be eliminated.

Furthermore, during preliminary driving, the liquid developer is withdrawn to tank 7 from liquid development reservoir 5. Specifically, the liquid developer is to be withdrawn to tank 7 at an amount such that metal roller 22 is not immersed in the liquid developer in liquid development reservoir 5.

By such withdrawal, the liquid developer will not be drawn up since metal roller 22 is not in contact with the liquid developer, avoiding the transportation of the liquid developer from metal roller 22 to transportation roller 21, and then from transportation roller 21 to development roller 2. Therefore, there is no liquid developer removed by cleaning blade 4 located at development roller 2. In other words, consumption of the liquid developer can be suppressed.

In the preliminary driving operation, the rotating direction of development roller 2 is set opposite to that of image formation. In an image formation operation, cleaning blade 4 is in contact with development roller 2 at an abutting angle in the direction in which force acts to dig into the surface of development roller 2, i.e. at an angle abutting from a counter direction relative to the rotating direction of development roller 2. In the case where development roller 2 is rotated during preliminary driving in the same direction as in image formation under a state where the liquid developer is not supplied, there is a possibility of cleaning blade 4 being rolled in. However, by rotating in a direction opposite to that of image formation, cleaning blade 4 can be prevented from being rolled in. Furthermore, in the case where development roller 2 during preliminary driving is rotated in the same direction as in image formation, development roller 2 and transportation roller 21 will rotate in opposite directions at the contact region. Here, the possibility of the torque of the roller drive increasing to attain unstable driving under the state where the liquid developer is not supplied can be prevented by development roller 2 and transportation roller 21 rotating in the same direction at the contact region. At this stage, development roller 2 and transportation roller 21 preferably rotate with no speed difference at the contact region.

Since development roller 2 and transportation roller 21 rotate in the same direction at the contact region in preliminary driving, rotation driving unit 35 may drive only one of transportation roller 21 and development roller 2 and cause the remaining roller to rotate in a driven manner.

Figure 3:
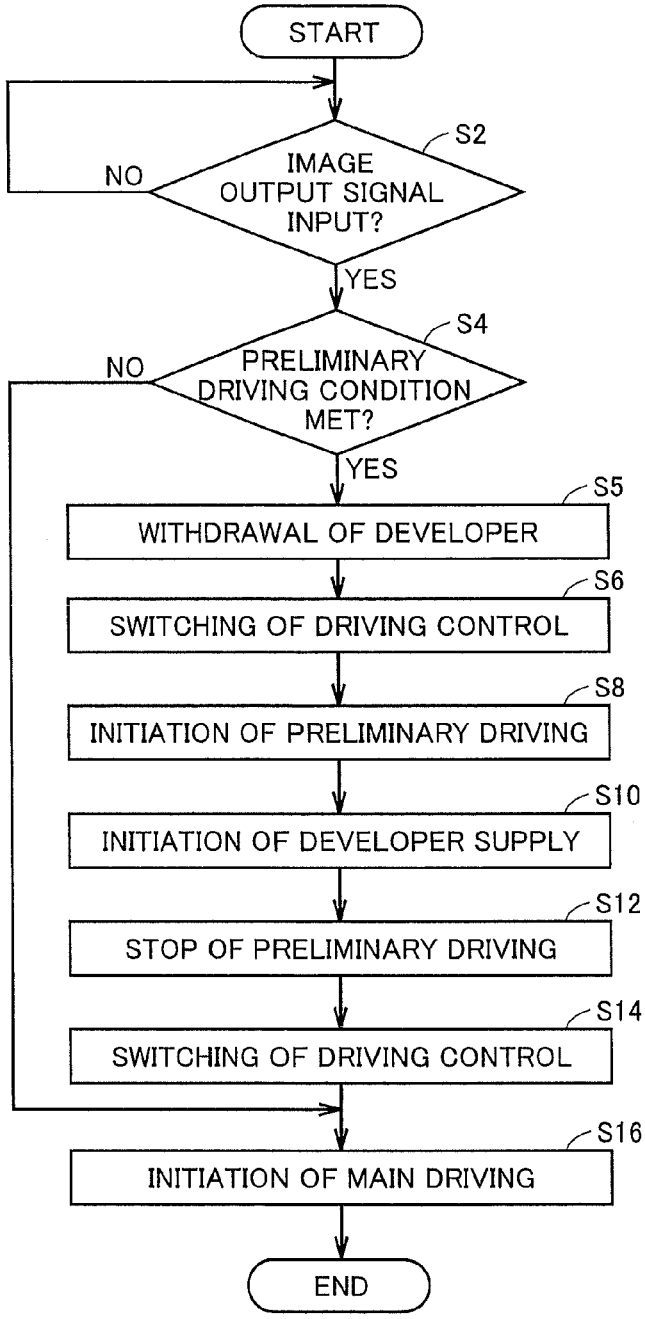
FIG. 3 is a flowchart to describe processing prior to main driving at a control unit 30 according to the embodiment of the present invention.

FIG. 3 is a flowchart to describe processing prior to main driving at control unit 30 according to the embodiment of the present invention.

Referring to FIG. 3, a determination is made as to whether an image output signal for forming an image has been input or not (step S2).

At step S2, when an image output signal has been input, control proceeds to step S4.

When an image output signal has not been input at step S2 (NO at step S2), the current state is maintained.

At step S4, a determination is made as to whether a preliminary driving condition is met or not. A preliminary driving condition may be, by way of example, a condition that a predetermined time has elapsed since a previous input of an image output signal. The condition is not particularly limited thereto, and a determination may be made with another condition as the preliminary driving condition. Although the present embodiment has been described corresponding to the case where a determination is made as to whether a preliminary driving condition is met or not at step S4, control may proceed from step S2 directly to step S5 without step S4, i.e. executing preliminary driving at every input of an image output signal.

When a determination is made that the preliminary driving condition is met at step S4 (YES at step S4), the developer is withdrawn (step S5). Specifically, control unit 30 instructs pump PC of FIG. 1 to output the liquid developer in liquid development reservoir 5 to tank 7. By this operation, the liquid developer in liquid development reservoir 5 is decreased, such that metal roller 22 attains a state not immersed in the liquid developer, as shown in FIG. 2 (B).

Then, the driving control is switched (step S6). Specifically, control unit 30 instructs rotation driving unit 35 of FIG. 1 to switch the drive to preliminary driving. In the present embodiment, the rotating direction of development roller 2 is switched to rotate in a direction opposite to that of main driving, by way of example. It is assumed that transportation roller 21 rotates in a direction identical to that of main driving.

Then, preliminary driving is initiated (step S8). Rotation driving unit 35 switches the driving for preliminary driving according to an instruction from control unit 30 to cause development roller 2 to rotate in the direction of c, as shown in FIG. 2 (B). Moreover, transportation roller 21 is rotated in the direction of e. By the relevant rotation, the strain at development roller 2 or the like can be eliminated. Since the rotating direction c of the development roller is opposite to the rotating direction b for the main driving, i.e. since the force acts in a direction that does not cause cleaning blade 4 to dig into the surface of development roller 2, the rolling-in of the cleaning blade can be prevented.

Then, supply of the developer is initiated (step S10). Specifically, control unit 30 instructs pump PB of FIG. 1 to output the liquid developer in tank 7 to liquid development reservoir 5. By this operation, liquid development reservoir 5 is filled with the liquid developer, and metal roller 22 attains a state immersed therein, as shown in FIG. 2 (A). The liquid developer is drawn up by the rotation of metal roller 22. An amount of liquid developer regulated by doctor blade 23 is transported from metal roller 22 to transportation roller 21, and then from transportation roller 21 to development roller 2.

Then, the preliminary driving is stopped (step S12). Preliminary driving may be stopped at a timing when, by way of example, the liquid developer arrives at the downstream side in the rotating direction of the development roller from the contact region of the cleaning blade and the development roller. By drawing up the liquid developer from metal roller 22 until that timing, the time required for drawing up the liquid developer, when switching to main driving, can be shortened. Furthermore, the transportation of the liquid developer onto the roller prevents the increase in torque between the rollers. Moreover, the rolling-in of the cleaning blade immediately after switching to main driving can be prevented.

The time of preliminary driving may be set to be executed for a given time such as approximately 10 seconds to 10 minutes, for example. Alternatively, the time of preliminary driving may be modified according to the stopped time, such as increasing the time for preliminary driving when stopped for a long period.

Then, driving control is switched (step S14). Specifically, control unit 30 instructs rotation driving unit 35 of FIG. 1 to switch to main driving. In the present embodiment, the rotating direction of development roller 2 is switched from direction c to direction b, by way of example. The rotating direction of transportation roller 21 is set in the same direction as in preliminary driving.

Then, main driving is initiated (step S16). Subsequently, the processing is terminated (end).

When a determination is made that the preliminary driving condition is not met at step S4 (NO at step S4), control proceeds to step S16 to initiate main driving. Subsequently, the processing is terminated (end).

An event of the preliminary driving condition not being met may be, for example, when the elapsed time from the previous driving is short. Since the possibility of strain being generated at development roller 2 is low in such a case, a determination is made that preliminary driving is not required.

Although a determination as to whether preliminary driving is to be executed or not is made when an image output signal is input in the present embodiment, the determination may be made at the time of startup when the power supply is turned ON. In that case, the determination at step S4 may be made to execute preliminary driving on the basis of an elapse of time from the previous power ON or power OFF, for example, such as when one or more days have elapsed from the previous power ON, or when 12 hours or more have elapsed from the previous power OFF. Alternatively, the elapsed time from the previous image output signal can be monitored to make a determination of executing preliminary driving when 12 hours or more, for example, have elapsed. In the case where preliminary driving is executed after the power has been turned ON, the flow is terminated after the operation of step S14 to attain a standby state for input of an image output signal.

Thus, the rotation of development roller 2 and the like during preliminary driving allows a strain to be eliminated. Furthermore, since the liquid developer is not drawn up after the initiation of preliminary driving until immediately preceding the stop of the preliminary driving, consumption of the liquid developer can be suppressed. Moreover, by setting the rotating direction of development roller 2 opposite to that of main driving of an image formation mode, the rolling-in of cleaning blade 4 can be prevented.

(First Modification)

Figure 4:
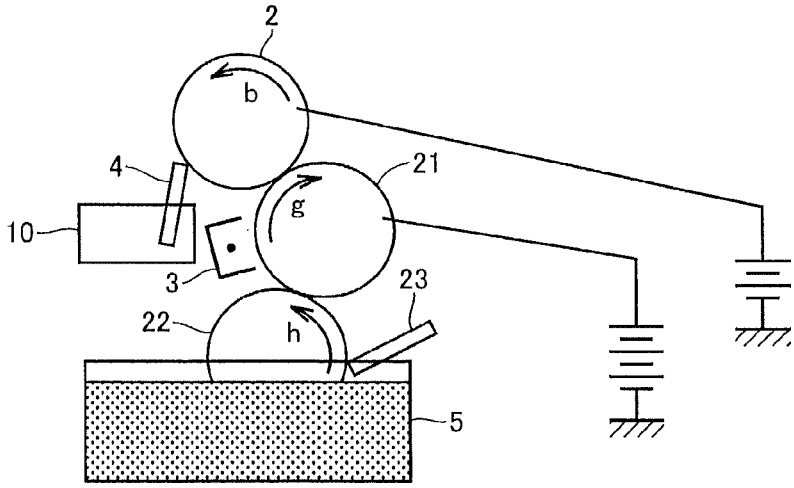
FIG. 4 is a diagram to describe a development device according to a first modification of the embodiment of the present invention.
Figure 4:
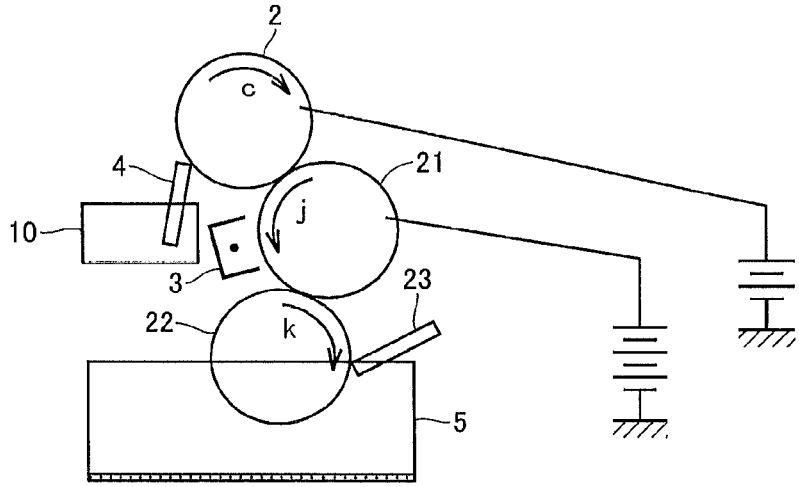

FIG. 4 is a diagram to describe a development device according to a first modification of the embodiment of the present invention.

Referring to FIG. 4 (A), the difference from FIG. 2 lies in that, in main driving, development roller 2, transportation roller 21, and metal roller 22 are rotating in the same direction to each other in the contact region. Specifically, metal roller 22 rotates in the direction of h. Transportation roller 21 rotates in the direction of g. Development roller 2 rotates in the direction of b.

The configuration of FIG. 4 (A) is similar to that of FIG. 2 (A), except that the rotating direction of transportation roller 21 and metal roller 22 differs. The toner can be charged using charging device 3 at transportation roller 21, and most of the toner at transportation roller 21 can be transferred to development roller 2 by applying voltage appropriately.

The rotation of each roller as set forth above causes the liquid developer to be drawn up by metal roller 22 from liquid development reservoir 5, and an amount of liquid developer regulated by doctor blade 23 is transported to transportation roller 21. Then, the liquid developer transported to transportation roller 21 is further supplied to development roller 2.

Referring to FIG. 4 (B), a preliminary driving operation of the development device prior to image formation is illustrated.

Control unit 30 instructs rotation driving unit 35 to cause development roller 2 and the like of the development device to rotate. Specifically, rotation driving unit 35 causes transportation roller 21 to rotate in direction j opposite to direction g of main driving. Since development roller 2 and metal roller 22 are rotated in a following manner, development roller 2 rotates in direction c opposite to direction b of main driving. Further, the rotating direction of metal roller 22 is in direction k opposite to direction h of main driving. In other words, in preliminary driving in the first modification, development roller 2, transportation roller 21 and metal roller 22 all rotate in a direction opposite to that of main driving.

Furthermore, in preliminary driving, the liquid developer is withdrawn to tank 7 from liquid development reservoir 5. Specifically, the liquid developer is withdrawn to tank 7 to a level such that metal roller 22 that was immersed in the liquid developer in liquid development reservoir 5 does not form contact with the liquid developer.

Therefore, by rotating development roller 2 and the like in preliminary driving prior to image formation, strain is eliminated. Furthermore, the liquid developer is not drawn up since metal roller 22 is not in contact with the liquid developer. The liquid developer will not be transported from metal roller 22 to transportation roller 21, and then to development roller 2 from transportation roller 21. Therefore, the event of the liquid developer being removed with cleaning blade 4 provided at development roller 2 is eliminated. In other words, consumption of the liquid developer can be suppressed.

During preliminary driving, the rotating direction of development roller 2 is set opposite to that of image formation. Cleaning blade 4 is in contact with development roller 2 at an abutting angle in the direction in which force acts to dig into the surface of development roller 2 during image formation, i.e. at an angle abutting from a counter direction relative to the rotating direction of development roller 2. In the case where development roller 2 is rotated during preliminary driving in the same direction as in image formation under a state where the liquid developer is not supplied, there is a possibility of cleaning blade 4 being rolled in. However, by rotating in a direction opposite to that of image formation, cleaning blade 4 can be prevented from being rolled in. Furthermore, in the case where development roller 2 and transportation roller 21 during preliminary driving are rotated in opposite directions to each other at the contact region, there is the possibility of the torque of the roller drive increasing to attain unstable driving under the state where the liquid developer is not supplied. However, torque increase can be prevented by development roller 2 and transportation roller 21 rotating in the same direction at the contact region. At this stage, development roller 2 and transportation roller 21 preferably rotate with no speed difference at the contact region.

(Second Modification)

Figure 5:
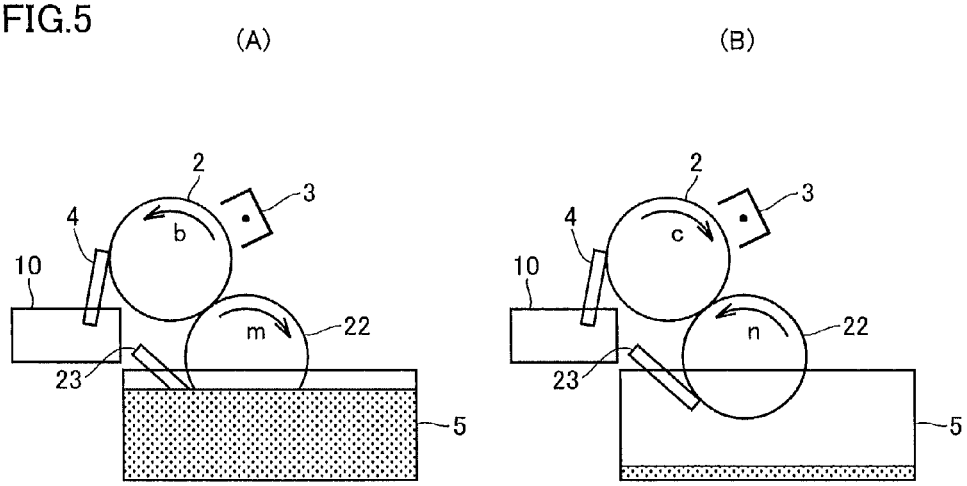
FIG. 5 is a diagram to describe a development device according to a second modification of the embodiment of the present invention.

FIG. 5 is a diagram to describe a development device according to a second modification of the embodiment of the present invention.

Referring to FIG. 5 (A), the difference from FIG. 2 lies in that transportation roller 21 is removed, and is based on a two-roller configuration with development roller 2 and metal roller 22. In the present example, metal roller 22 functions as a transportation member to transport the liquid developer to development roller 2.

The liquid developer is transported directly from metal roller 22 to development roller 2.

The remaining elements are similar to those in FIG. 2. In main driving, development roller 2 and metal roller 22 rotate in the same direction with respect to each other in the contact region.

Rotation in the aforementioned direction causes the liquid developer to be drawn up from liquid development reservoir 5 by metal roller 22, and the liquid developer is supplied to development roller 2. Metal roller 22 rotates in the direction of m. Development roller 2 rotates in the direction of b.

Referring to FIG. 5 (B), a preliminary driving operation of the development device prior to image formation is illustrated.

Control unit 30 instructs rotation driving unit 35 to cause rotation of metal roller 22 at the development device. Specifically, rotation driving unit 35 causes metal roller 22 to rotate in the direction of n opposite to direction m of main driving. Since development roller 2 rotates in a following manner, development roller 2 rotates in direction c opposite to direction b of main driving. Although the present example has been described corresponding to the case of driving metal roller 22, development roller 2 may be driven instead, or both be driven.

In preliminary driving, the liquid developer is withdrawn to tank 7 from liquid development reservoir 5. Specifically, the liquid developer is withdrawn to tank 7 to a level such that metal roller 22 that was immersed in the liquid developer in liquid development reservoir 5 does not form contact with the liquid developer.

Therefore, by rotating development roller 2 in preliminary, strain is eliminated. Furthermore, the liquid developer is not drawn up since metal roller 22 is not in contact with the liquid developer. The liquid developer will not be transported from metal roller 22 to development roller 2. Therefore, the event of the liquid developer being removed with cleaning blade 4 provided at development roller 2 is eliminated. In other words, consumption of the liquid developer can be suppressed.

During preliminary driving, the rotating direction of development roller 2 is set opposite to that of image formation. Cleaning blade 4 is in contact with development roller 2 at an abutting angle in the direction in which force acts to dig into the surface of development roller 2 during image formation, i.e. at an angle abutting from a counter direction relative to the rotating direction of development roller 2. In the case where development roller 2 is rotated during preliminary driving in the same direction as in image formation under a state where the liquid developer is not supplied, there is a possibility of cleaning blade 4 being rolled in. However, by rotating in a direction opposite to that of image formation, cleaning blade 4 can be prevented from being rolled in. Furthermore, in the case where development roller 2 and metal roller 22 during preliminary driving are rotated in opposite directions to each other at the contact region, there is the possibility of the torque of the roller drive increasing to attain unstable driving under the state where the liquid developer is not supplied. However, torque increase can be prevented by development roller 2 and metal roller 22 rotating in the same direction at the contact region. At this stage, development roller 2 and transportation roller 21 preferably rotate with no speed difference at the contact region.

Example

In two exemplified configurations including development roller 2, transportation roller 21 and metal roller 22 set forth above, the power was turned ON after three days since the last image output signal was input, and preliminary driving was executed.

In the relevant example, the driving of development roller 2 was canceled in preliminary driving to cause rotation following the rotation of transportation roller 21. Further, the liquid developer was output to tank 7 from liquid development reservoir 5 such that metal roller 22 attains a state not immersed in the liquid development developer.

Furthermore, the development roller, transportation roller, and the metal roller were rotated, as necessary, at 400 mm/sec.

First, preliminary driving was executed for 5 minutes without the liquid development developer being supplied. At an elapse of 5 minutes, supply of the liquid developer to liquid development reservoir 5 was initiated without stopping the rotation of the roller. Then, metal roller 22 was immersed in the liquid developer, and preliminary driving was stopped under the state where the liquid developer was sufficiently delivered to development roller 2.

Then, by switching the driving control to main driving, and outputting a halftone image, a regular image without line noise was obtained according to each configuration.

Comparative Example

Halftone images output in the example of the two configurations set forth above without preliminary driving exhibited generation of a plurality of line noises in the direction perpendicular to the sheet passing direction.

(Third Modification)

Although the scheme of drawing up the liquid developer under the state where metal roller 22 is immersed in liquid development reservoir 5 has been described in the above configurations, the liquid developer can be drawn up without the aforementioned configuration.

Figure 6:
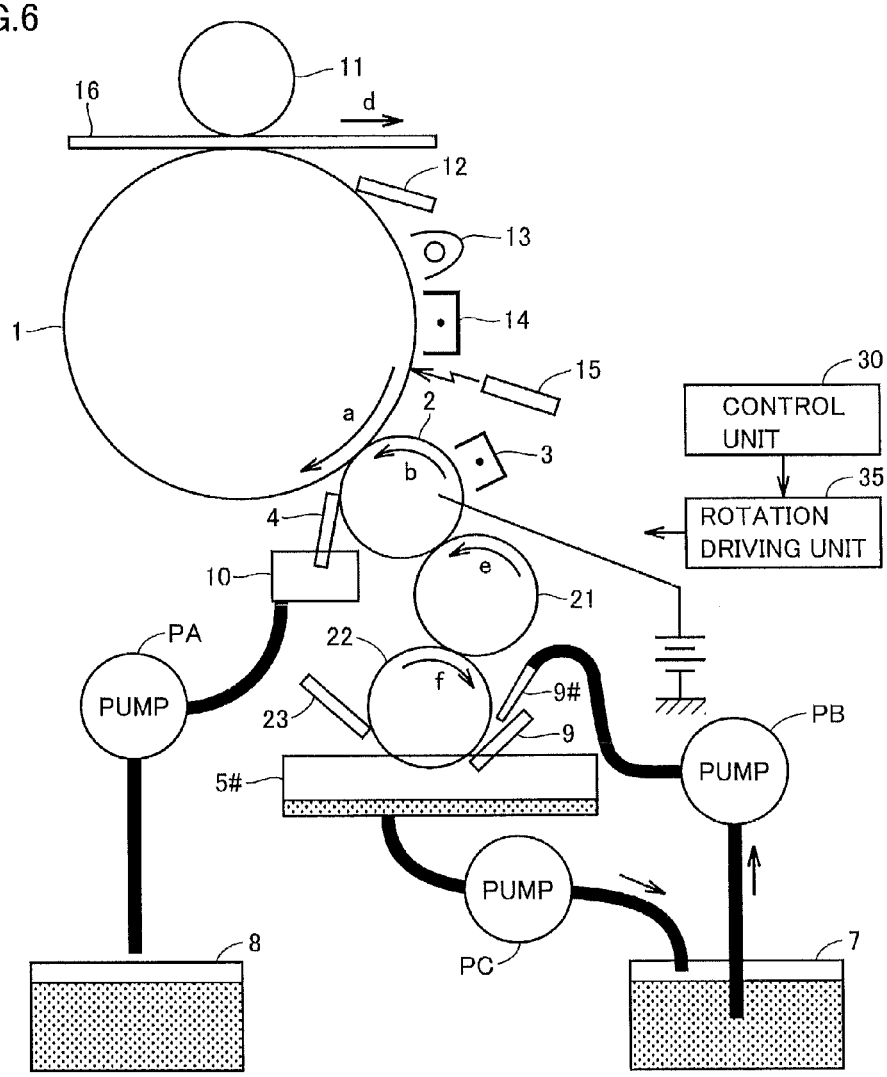
FIG. 6 schematically represents a wet type image forming device using a liquid developer according to a third modification of the embodiment of the present invention.

FIG. 6 schematically represents a wet type image forming device using a liquid developer according to a third modification in the embodiment of the present invention.

Referring to FIG. 6, the difference from the configuration of FIG. 1 lies in that liquid development reservoir 5 is replaced with a liquid development reservoir 5#, a supply opening 9# for the liquid developer is provided at the head of pump PB, and a delivery member 9 having a length substantially equal to the length of metal roller 22 in the axis direction is provided to deliver the liquid developer supplied from supply opening 9# to metal roller 22.

For example, the liquid developer is supplied from supply opening 9# to delivery member 9, as shown in FIG. 6. Liquid collect is generated between delivery member 9 and metal roller 22, which causes the liquid developer to be transferred to metal roller 22. The remaining liquid developer not transferred is collected in a liquid development reservoir 5#, and returns back to liquid development tank 7 from liquid development reservoir 5# by pump PC. In other words, supply of the liquid developer to metal roller 22 is allowed even if metal roller 22 does not attain a state immersed in the liquid developer in liquid development reservoir 5#. Since the supply of the liquid developer can be started or stopped by just operating or stopping pump PB, the time required for filling liquid development reservoir 5 with liquid developer, or withdrawing the liquid developer therefrom is no longer required, as compared to the configuration of FIG. 1.

The remaining elements are similar to those described with reference to FIG. 1 Therefore, detailed description thereof will not be repeated.

Although the embodiments and modifications of the present invention were described based on a wet type development device, the same applies to a dry type development device.

For example, in a wet type one-component development device including a development roller for developing an electrostatic latent image on a photoreceptor, a cleaning member abutting against the development roller, a transportation roller for transporting a developer to the development roller, and a developer tank supplying the developer to the transportation roller, preliminary driving for a given time can be executed in order to eliminate strain at the development roller that is a resilient member.

Furthermore, by stopping the supply of the developer to the development roller at the time of starting preliminary driving, extra consumption and/or degradation of the developer can be suppressed. Specifically, a method of withdrawing the developer in the developer tank to a reservoir provided in proximity can be carried out, by way of example. In this case, the delivery of the developer between the developer tank and reservoir may be executed by operating a transportation screw and a vent provided at the inlet/outlet.

In the case where the cleaning member is a blade, there is a possibility of the blade being rolled in when the development roller is rotated under a state where a developer is not supplied. Therefore, the rotating direction of the development roller during preliminary driving is preferably set opposite to that of the main drive in an image formation mode.

Furthermore, by initiating supply of the developer to the development roller immediately before ending the preliminary driving, the time required before image formation is started can be shortened, and rolling-in of the cleaning blade, when switching to main driving, can be prevented. In the present example, the transportation screw is to be rotated in a direction opposite to that set forth above to cause the developer withdrawn in the reservoir to be returned to the developer tank.

Although the present invention has been described and illustrated in detail, it is clearly understood that the embodiments disclosed herein are made by way of illustration and example only and are not to be taken by way of limitation. The scope of the present invention is defined by the terms of the claims, rather than the description above, and is intended to include any modification within the scope and meaning equivalent to the terms of the claims.

Reference Signs List

1 photoreceptor; 2 development roller; 3 charging device; 4, 12 cleaning blade; 5 liquid development reservoir; 7 tank; 8 adjustment tank; 10 collecting bin; 11 transfer roller; 13 discharger; 14 charger; 15 exposing unit; 16 recording medium; 30 control unit; 35 rotation drive unit.

The invention claimed is:

1. An image forming device comprising:

a development member carrying a developer for forming a toner image at an image carrier;

a cleaning member abutting against said development member for removing the developer remaining on said development member;

a transportation member provided in contact with said development member for transporting said developer supplied to said development member; and a driving unit controlling driving of at least one of said transportation member and said development member, wherein at least one of said development member and said transportation member is formed of a resilient material, and said driving unit executes preliminary driving of said development member and said transportation member such that said development member and said transportation member are rotated for a given time under a state where said developer is not supplied to said transportation member, prior to main driving in image formation.

2. The image forming device according to claim 1, wherein said driving unit rotates, in said preliminary driving, said development member in a direction opposite to a rotating direction of said development member during said main driving.

3. The image forming device according to claim 1, wherein said driving unit rotates said development member and said transportation member without speed difference during said preliminary driving, when said development member and said transportation member are driven to rotate in a same direction at a contact region thereof.

4. The image forming device according to claim 1, wherein said driving unit controls driving of only one of said transportation member and said development member, and the other of said transportation member and said development member is driven following rotation of the driving.

5. The image forming device according to claim 1, wherein:

said developer is a liquid developer; and said liquid developer is supplied before said driving unit stops said preliminary driving.

6. The image forming device according to claim 1, wherein said cleaning member abuts against said development member from a counter direction to a rotating direction of said development member during said main driving.

7. The image forming device according to claim 1, wherein said developer is a liquid developer, said image forming device further comprising:

a reservoir for storing said developer to supply said developer to said transportation member; and a pump unit supplying, during said main driving, said developer to said reservoir such that at least a portion of said transportation member is immersed in said developer, and discharging said developer from said reservoir such that said transportation member is not immersed in said developer when said preliminary driving is initiated.

8. An image forming device comprising:

a development member carrying a developer for forming a toner image at an image carrier;

a transportation member provided in contact with said development member for transporting said developer supplied to said development member;

a driving unit controlling driving of at least one of said transportation member and said development member;

a reservoir for storing said developer to supply said developer to said transportation member; and a pump unit for supplying, during main driving, said developer to said reservoir such that at least a portion of said transportation member is immersed in said developer, wherein said driving unit executes preliminary driving of said development member and said transportation member for a given time prior to main driving in image formation, and when said preliminary driving is initiated, said pump unit discharges said developer from said reservoir such that said transportation member is not immersed in said developer thereby stopping the supply of said developer to said transportation member.

9. The image forming device according to claim 8, wherein said driving unit rotates, in said preliminary driving, said development member in a direction opposite to a rotating direction of said development member during said main driving.

10. The image forming device according to claim 8, wherein said driving unit rotates said development member and said transportation member without speed difference during said preliminary driving, when said development member and said transportation member are driven to rotate in a same direction at a contact region thereof.

11. The image forming device according to claim 8, wherein said driving unit controls driving of only one of said transportation member and said development member, and the other of said transportation member and said development member is driven following rotation of the driving.

12. An image forming device comprising:

a development member carrying a developer for forming a toner image at an image carrier;

a transportation member provided in contact with said development member for transporting said developer supplied to said development member;

a driving unit controlling driving of at least one of said transportation member and said development member, wherein said driving unit (i) executes preliminary driving of said development member and said transportation member for a given time under a state where supply of said developer to said transportation member is stopped, prior to main driving in image formation and (ii) rotates said development member and said transportation member without speed difference during said preliminary driving, when said development member and said transportation member are driven to rotate in a same direction at a contact region thereof.

* * * * *